US012258644B2

(12) United States Patent
Hasegawa et al.

(10) Patent No.: US 12,258,644 B2
(45) Date of Patent: Mar. 25, 2025

(54) HIGH-STRENGTH GALVANIZED STEEL SHEET AND METHOD FOR MANUFACTURING THE SAME

(71) Applicant: JFE Steel Corporation, Tokyo (JP)

(72) Inventors: Hiroshi Hasegawa, Tokyo (JP); Tatsuya Nakagaito, Tokyo (JP); Kana Sasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 771 days.

(21) Appl. No.: 17/421,475

(22) PCT Filed: Oct. 2, 2019

(86) PCT No.: PCT/JP2019/038832
§ 371 (c)(1),
(2) Date: Jul. 8, 2021

(87) PCT Pub. No.: WO2020/148948
PCT Pub. Date: Jul. 23, 2020

(65) Prior Publication Data

US 2022/0064754 A1 Mar. 3, 2022

(30) Foreign Application Priority Data

Jan. 18, 2019 (JP) ..... 2019-006974

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/28*** | (2006.01) |
| ***C23C 2/40*** | (2006.01) |

(52) U.S. Cl.
CPC ..... *C21D 9/46* (2013.01); *C21D 8/0226* (2013.01); *C21D 8/0236* (2013.01); *C21D 8/0263* (2013.01); *C21D 8/0273* (2013.01); *C22C 38/002* (2013.01); *C22C 38/02* (2013.01); *C22C 38/04* (2013.01); *C22C 38/06* (2013.01); *C23C 2/28* (2013.01); *C23C 2/29* (2022.08); *C23C 2/40* (2013.01); *C21D 2201/05* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
None
See application file for complete search history.

(56) References Cited

U.S. PATENT DOCUMENTS

| | | | | |
|---|---|---|---|---|
| 2017/0268077 | A1 | 9/2017 | Murakami et al. | |
| 2018/0030564 | A1* | 2/2018 | Hasegawa | C21D 9/46 |
| 2020/0087764 | A1 | 3/2020 | Sano et al. | |

FOREIGN PATENT DOCUMENTS

| | | | |
|---|---|---|---|
| CN | 104561775 | A | 4/2015 |
| CN | 107109571 | A | 8/2017 |
| EP | 3178956 | A1 | 6/2017 |
| EP | 3219821 | A1 | 9/2017 |
| EP | 3225708 | A1 | 10/2017 |
| EP | 3564400 | A1 | 11/2019 |
| JP | 2008291304 | A | 12/2008 |
| JP | 2009263752 | A | 11/2009 |
| JP | 2011195956 | A | 10/2011 |
| JP | 2016224359 | A | 12/2015 |
| JP | 2016008310 | A | 1/2016 |
| JP | 6213696 | B1 | 10/2017 |
| WO | 2016084847 | A1 | 6/2016 |
| WO | 2016103534 | A1 | 6/2016 |
| WO | 2017208763 | A1 | 12/2017 |
| WO | 2018124157 | A1 | 7/2018 |

OTHER PUBLICATIONS

Chinese Office Action with Search Report for Chinese Application No. 201980089186.3, dated Apr. 28, 2022, 8 pages.
International Search Report and Written Opinion for International Application No. PCT/JP2019/038832, dated Dec. 24, 2019, 5 pages.
European Communication pursuant to Article 94(3) for European Application No. 19 910 284.9, dated Apr. 20, 2022, 5 pages.
Extended European Search Report for European Application No. 19 910 284.9, dated Sep. 9, 2021, 7 pages.

* cited by examiner

*Primary Examiner* — Xiaowei Su
(74) *Attorney, Agent, or Firm* — Buchanan Ingersoll & Rooney PC

(57) ABSTRACT

A high-strength galvanized steel sheet includes a base steel sheet and a galvanized layer on a surface thereof. The base steel sheet has a predetermined chemical composition and a microstructure in which an area fraction of martensite is 30% or less, an area fraction of pearlite is 1% or less, a total area fraction of tempered martensite and carbide-containing bainite is 30% or more and 99% or less, an area fraction of retained austenite is 1% to 20%, and a total area fraction of ferrite and non-carbide-containing bainite is 45% or less in the steel sheet microstructure in a predetermined region and in which an area fraction of retained austenite grains having two or more crystal orientations is 40% or less in all the retained austenite grains in a predetermined region.

6 Claims, No Drawings

HIGH-STRENGTH GALVANIZED STEEL SHEET AND METHOD FOR MANUFACTURING THE SAME

CROSS REFERENCE TO RELATED APPLICATIONS

This is the U.S. National Phase applications of PCT/JP2019/038832, filed Oct. 2, 2019 which claims priority to Japanese Patent Application No. 2019-006974, filed Jan. 18, 2019, the disclosures of these applications being incorporated herein by reference in their entireties for all purposes.

FIELD OF THE INVENTION

The present invention relates to a high-strength galvanized steel sheet which can preferably be used for automobile members and which is excellent in terms of workability, and to a method for manufacturing the steel sheet.

BACKGROUND OF THE INVENTION

To improve the collision safety and fuel efficiency of automobiles, there is a demand for increasing the strength of a steel sheet used for automobile parts. In particular, since there is a demand for increasing the deformation performance of skeleton parts around a cabin from the viewpoint of occupant protection, there is a requirement for a steel sheet having high yield strength (hereinafter, referred to as "YS"). On the other hand, since an increase in yield strength causes a deterioration in workability, there is a problem of an increase in the degree of difficulty in forming parts. In addition, since many of the parts around a cabin including a center pillar are required to have satisfactory rust resistance, there has been a demand for, in particular, a galvanized steel sheet. Against such a background, there is a demand for a galvanized steel sheet having high yield strength and excellent workability.

Patent Literature 1 discloses a technique for manufacturing a steel sheet having a tensile strength of over 1180 MPa grade and excellent uniform ductility and local ductility by controlling the amount of retained austenite and plural volume fractions of tempered martensite.

Patent Literature 2 discloses a technique for manufacturing a high-strength steel sheet having excellent elongation and stretch flange formability by forming a microstructure containing mainly tempered martensite and bainite in which the nano hardness, the texture, and so forth are controlled.

Patent Literature 3 discloses a technique regarding a method for manufacturing a steel sheet having a tensile strength of over 540 MPa grade and excellent elongation and stretch flange formability by controlling the crystal misorientations of ferrite and hard phases.

PATENT LITERATURE

PTL 1: Japanese Patent No. 6213696

PTL 2: Japanese Unexamined Patent Application Publication No. 2016-8310

PTL 3: Japanese Unexamined Patent Application Publication No. 2009-263752

SUMMARY OF THE INVENTION

However, the technique according to Patent Literature 1 is intended only for elongation in tensile deformation, not for an improvement in the workability of a flange, which is essential for forming parts in practice. Although the technique according to Patent Literature 2 is intended for an improvement in elongation and stretch flange formability, since no consideration is given to achieving such properties along with satisfactory YS, which is important for skeleton parts, there is a room for improvement. Although the technique according to Patent Literature 3 provides excellent elongation and stretch flange formability, high levels of YS, elongation, and stretch flange formability are not achieved at the same time.

Aspects of the present invention have been completed in view of the situations described above, and an object according to aspects of the present invention is to provide a high-strength galvanized steel sheet having excellent workability and a method for manufacturing the steel sheet.

The present inventors diligently conducted investigations to solve the problems described above and, as a result, found that it is possible to obtain a galvanized steel sheet having high strength and excellent workability in the case where a base steel sheet has a predetermined chemical composition and a microstructure in which the area fraction of martensite is 30% or less, the area fraction of pearlite is 1% or less, the total area fraction of tempered martensite and carbide-containing bainite is 30% or more and 99% or less, the area fraction of retained austenite is 1% to 20%, and the total area fraction of ferrite and non-carbide-containing bainite is 45% or less in the steel sheet microstructure in a region from a position located 300 μm from the steel sheet surface to a position located 400 μm from the steel sheet surface and in which the area fraction of retained austenite grains having two or more crystal orientations is 40% or less in all the retained austenite grains in a region from a position located 300 μm from the steel sheet surface to a position located 400 μm from the steel sheet surface. Aspects of the present invention have been completed on the basis of the knowledge described above, and the subject matter according to aspects of the present invention is as follows.

[1] A high-strength galvanized steel sheet including a base steel sheet and a galvanized layer on a surface of the base steel sheet, wherein the base steel sheet has a chemical composition containing, by mass %, C: 0.12% to 0.35%, Si: 0.5% to 3.0%, Mn: 1.5% to 4.0%, P: 0.100% or less (not including 0%), S: 0.02% or less (not including 0%), Al: 0.01% to 1.50%, with the balance being Fe and inevitable impurities, and wherein the base steel sheet has a microstructure in which an area fraction of martensite is 30% or less, an area fraction of pearlite is 1% or less, a total area fraction of tempered martensite and carbide-containing bainite is 30% or more and 99% or less, an area fraction of retained austenite is 1% to 20%, and a total area fraction of ferrite and non-carbide-containing bainite is 45% or less in the steel sheet microstructure in a region from a position located 300 μm from the steel sheet surface to a position located 400 μm from the steel sheet surface and in which an area fraction of retained austenite grains having two or more crystal orientations is 40% or less in all the retained austenite grains in a region from a position located 300 μm from the steel sheet surface to a position located 400 μm from the steel sheet surface.

[2] The high-strength galvanized steel sheet according to [1], wherein the base steel sheet has the chemical composition further containing, by mass %, at least one selected from Cr: 0.005% to 2.0%,
Ni: 0.005% to 2.0%,
Cu: 0.005% to 2.0%,
V: 0.1% to 1.5%,
Mo: 0.1% to 1.5%,
Ti: 0.005% to 0.10%,
Nb: 0.005% to 0.10%,
B: 0.0001% to 0.0050%,
Ca: 0.0003% to 0.0050%,
REM: 0.0003% to 0.0050%,
Sn: 0.005% to 0.50%, and
Sb: 0.005% to 0.50%.

[3] The high-strength galvanized steel sheet according to [1] or [2], wherein the galvanized layer is a galvannealed layer.

[4] A method for manufacturing a high-strength galvanized steel sheet, the method including:

performing a hot rolling process of performing hot rolling a slab having the chemical composition according to [1] or [2] thereafter cooling and coiling, holding the hot-rolled steel sheet, which has been obtained in the hot rolling process, or a cold-rolled steel sheet, which has been obtained by further performing cold rolling the hot-rolled steel sheet with a rolling reduction ratio of 30% or more, in a temperature range from (Ac1−5° C.) to (Ac1+10° C.) for 15 s or more while applying a tension of 0 MPa (not inclusive) to 10 MPa, heating the held steel sheet to an annealing temperature of 750° C. to 940° C. and holding the steel sheet at the annealing temperature for 10 s to 600 s, cooling the annealed steel sheet to a primary cooling stop temperature, which is from Ms to 550° C., under a condition in which cooling is performed at a primary average cooling rate of 3° C./s or higher in a temperature range from the annealing temperature to a temperature of 550° C., holding the cooled steel sheet at a galvanizing treatment temperature, which is from Ms to 580° C., for 10 s to 300 s while performing a galvanizing treatment which is optionally followed by an alloying treatment of galvanized layer, cooling the galvanized steel sheet to a secondary cooling stop temperature of 50° C. to 350° C. under a condition in which cooling is performed at a secondary average cooling rate of 50° C./s or higher in a temperature range from the galvanizing treatment temperature to a temperature of 350° C., and heating the cooled steel sheet to a reheating temperature which is higher than the secondary cooling stop temperature and which is within a range of 300° C. to 500° C., holding the steel sheet at the reheating temperature for 1 s to 600 s, and cooling the held steel sheet to room temperature.

In accordance with aspects of the present invention, the expression "high-strength" denotes a case where the YS is 850 MPa or more. In addition, in accordance with aspects of the present invention, the expression "excellent workability" denotes a case where the uniform elongation (UEL) is 9.0% or more and (YS×(uniform elongation (UEL))×(hole expansion ratio λ)) is 270 GPa·%·% or more.

In accordance with aspects of the present invention, the meaning of "galvanized steel sheet" includes not only a galvanized steel sheet but also a galvannealed steel sheet. In addition, in the case where it is necessary to distinguish between a galvanized steel sheet and a galvannealed steel sheet, these steel sheets are described separately.

According to aspects of the present invention, it is possible to provide a high-strength galvanized steel sheet having excellent workability and a method for manufacturing the steel sheet. Such a high-strength galvanized steel sheet can preferably be used as a material for automobile parts.

DETAILED DESCRIPTION OF EMBODIMENTS OF THE INVENTION

Hereafter, embodiments of the present invention will be described. Here, the present invention is not limited to the embodiments described below.

1) Chemical Composition

The chemical composition of the base steel sheet of the high-strength galvanized steel sheet according to aspects of the present invention will be described. In the description of the chemical composition below, "%" is the unit used when describing the contents of the constituents and denotes "mass %".

C: 0.12% to 0.35%

C is an element which is effective for increasing strength by increasing the strength of tempered martensite and carbide-containing bainite and for forming retained austenite. In the case where the C content is less than 0.12%, since it is not possible to sufficiently realize such effects, it is not possible to achieve the strength or steel microstructure according to aspects of the present invention. Therefore, the C content is set to be 0.12% or more, preferably 0.14% or more, or more preferably 0.15% or more. On the other hand, in the case where the C content is more than 0.35%, since an excessive amount of retained austenite is formed, it is not possible to form the steel microstructure according to aspects of the present invention. Therefore, the C content is set to be 0.35% or less or preferably 0.32% or less.

Si: 0.5% to 3.0%

Si is an element which is necessary to increase the strength of steel through solid solution strengthening and to form retained austenite. To sufficiently realize such effects, it is necessary that the Si content be 0.5% or more or preferably 0.8% or more. On the other hand, in the case where the Si content is more than 3.0%, since an excessive amount of ferrite is formed, it is not possible to form the steel microstructure according to aspects of the present invention. Therefore, the Si content is set to be 3.0% or less, preferably 2.5% or less, or more preferably 2.0% or less.

Mn: 1.5% to 4.0%

Mn is an element which is effective for increasing strength by forming martensite and bainite. In the case where the Mn content is less than 1.5%, it is not possible to sufficiently realize such an effect. Therefore, the Mn content is set to be 1.5% or more, preferably 1.8% or more, or more preferably 2.0% or more. On the other hand, in the case where the Mn content is more than 4.0%, since embrittlement occurs in steel, it is not possible to achieve the excellent workability according to aspects of the present invention. Therefore, the Mn content is set to be 4.0% or less, preferably 3.7% or less, or more preferably 3.4% or less.

P: 0.100% or Less (not Including 0%)

Since P causes a deterioration in workability by causing embrittlement to occur in steel, it is preferable that the P content be as small as possible. However, in accordance with aspects of the present invention, it is acceptable that the P content be 0.100% or less. Here, since it is difficult to control the P content to be 0% in a practical operation, the P content range does not include 0%. In addition, since there is a decrease in production efficiency in the case where an attempt is made to decrease the P content to be less than 0.001%, it is preferable that the P content be 0.001% or more.

S: 0.02% or Less (not Including 0%)

Since S causes a deterioration in workability by increasing the amount of inclusions, it is preferable that the S content be as small as possible. However, in accordance with aspects of the present invention, it is acceptable that the S content be 0.02% or less. Here, since it is difficult to control the S content to be 0% in a practical operation, the S content range does not include 0%. In addition, since there is a decrease in production efficiency in the case where an attempt is made to decrease the S content to be less than 0.0001%, it is preferable that the S content be 0.0001% or more.

Al: 0.01% to 1.50%

Since Al functions as a deoxidizing agent, it is preferable that Al be added in a deoxidizing process. In addition, Al is an element which is effective for forming retained austenite. To realize such effects, it is necessary that the Al content be 0.01% or more or preferably 0.02% or more. On the other hand, in the case where the Al content is more than 1.50%, since an excessive amount of ferrite is formed, it is not possible to form the steel microstructure according to aspects of the present invention. Therefore, the Al content is set to be 1.50% or less, preferably 1.0% or less, or more preferably 0.70% or less.

The constituents described above are the basic constituents. The steel sheet according to aspects of the present invention has a chemical composition containing the basic constituents described above and a balance of Fe (iron) and inevitable impurities. Here, it is preferable that the steel sheet according to aspects of the present invention have a chemical composition containing the basic constituents described above and a balance of Fe and inevitable impurities. In addition, the steel sheet according to aspects of the present invention may further contain the following optional constituents as needed in addition to the basic constituents. The remainder which is different from the basic constituents and the optional constituents is iron and inevitable impurities.

At least one selected from Cr: 0.005% to 2.0%, Ni: 0.005% to 2.0%, Cu: 0.005% to 2.0%, V: 0.1% to 1.5%, Mo: 0.1% to 1.5%, Ti: 0.005% to 0.10%, Nb: 0.005% to 0.10%, B: 0.0001% to 0.0050%, Ca: 0.0003% to 0.0050%, REM: 0.0003% to 0.0050%, Sn: 0.005% to 0.50%, and Sb: 0.005% to 0.50%

Cr, Ni, and Cu are elements which are effective for increasing strength by forming martensite and bainite. To realize such an effect, it is preferable that the content of each of these elements be equal to or more than the above-described lower limit of the content thereof. On the other hand, it is preferable that the content of each of Cr, Ni, and Cu be equal to or less than the above-described upper limit of the content thereof from the viewpoint of improving workability.

V, Mo, Ti, and Nb are elements which are effective for increasing strength through precipitation strengthening. To realize such an effect, it is preferable that the content of each of these elements be equal to or more than the above-described lower limit of the content thereof. On the other hand, in the case where the content of each of these elements is more than the above-described upper limit of the content thereof, since there is a decrease in the amount of solid solution carbon in steel due to an increase in the grain diameter of carbides, a large amount of ferrite is formed, which results in the steel microstructure according to aspects of the present invention not being formed.

B is an element which is effective for increasing strength by improving the hardenability of a steel sheet and by thereby forming martensite and bainite. To sufficiently realize such an effect, it is preferable that the B content be 0.0001% or more. On the other hand, in the case where the B content is more than 0.0050%, since there is an increase in the amount of inclusions, there is a tendency for workability to be deteriorated. Therefore, it is preferable that the B content be 0.0050% or less.

Ca and REM are elements which are effective for improving workability by controlling the morphology of inclusions. To realize such an effect, it is preferable that the content of each of Ca and REM be equal to or more than the above-described lower limit of the content thereof. On the other hand, in the case where the content of each of Ca and REM is more than the above-described upper limit of the content thereof, since there is an increase in the amount of inclusions, there is a tendency for workability to be deteriorated. Therefore, it is preferable that the content of each of Ca and REM be equal to or less than the above-described upper limit of the content thereof.

Sn and Sb are elements which are effective for inhibiting a decrease in the strength of steel by inhibiting the removal of nitrogen, boron, and the like. To realize such an effect, it is preferable that the content of each of Sn and Sb be equal to or more than the above-described lower limit of the content thereof. On the other hand, in the case where the content of each of Sn and Sb is more than the above-described upper limit of the content thereof, since embrittlement occurs in steel, there is a tendency for workability to be deteriorated. Therefore, it is preferable that the content of each of Sn and Sb be equal to or less than the above-described upper limit of the content thereof.

The steel sheet according to aspects of the present invention may further contain Zr, Mg, La, and Ce to a total amount of 0.002% as needed.

2) Steel Sheet Microstructure

The steel sheet microstructure of a high-strength galvanized steel sheet will be described. In the description below, the expression "area fraction in a steel sheet microstructure" denotes the area fraction in a steel sheet microstructure in a region from a position located 300 μm from the steel sheet surface to a position located 400 μm from the steel sheet surface. Here, in accordance with aspects of the present invention, the reason why the control of a steel sheet microstructure in a region from a position located 300 μm from the steel sheet surface to a position located 400 μm from the steel sheet surface is important is presumed to be because an improvement in uniform elongation (UEL) and the hole expansion ratio (λ), which are intended in accordance with aspects of the present invention, has an effect on necking and void generation occurring in the above-described region in the thickness direction of the steel sheet.

Area Fraction of Martensite: 30% or Less

Since martensite causes a deterioration in workability while causing an increase in strength, it is necessary that the area fraction thereof be 30% or less. In the case where the area fraction is more than 30%, it is not possible to achieve the workability according to aspects of the present invention. Therefore, the area fraction of martensite is set to be 30% or less, preferably 25% or less, more preferably 15% or less, or even more preferably 10% or less. Here, although there is no particular limitation on the lower limit of the area fraction, the area fraction is 1% or more in many cases.

Area Fraction of Pearlite: 1% or Less (Including 0%)

Since pearlite causes a deterioration in strength-uniform elongation balance, it is necessary that the amount of pearlite be as small as possible. In the case where the area fraction is more than 1%, it is not possible to achieve the strength-uniform elongation balance according to aspects of the present invention. Therefore, the area fraction of pearlite is set to be 1% or less.

Total Area Fraction of Tempered Martensite and Carbide-Containing Bainite: 30% or More and 99% or Less Tempered martensite and carbide-containing bainite are phases which are necessary to achieve high strength and high workability. In the case where the total area fraction of these phases is less than 30%, it is not possible to achieve the strength and workability according to aspects of the present invention at the same time. Therefore, the total area fraction of tempered martensite and carbide-containing bainite is set to be 30% or more, preferably 40% or more, or more preferably 50% or more. Although there is no particular limitation on the upper limit of the total area fraction of tempered martensite and carbide-containing bainite from the viewpoint of achieving the high strength and high workability according to aspects of the present invention, the total area fraction is set to be 99% or less in consideration of the relationship with the area fractions of other phases.

Area Fraction of Retained Austenite: 1% to 20%

Retained austenite is a phase which is necessary to increase uniform elongation. In the case where the area fraction of retained austenite is less than 1%, it is not possible to sufficiently realize such an effect. Therefore, the area fraction of retained austenite is set to be 1% or more, preferably 3% or more, or more preferably 5% or more. On the other hand, in the case where the area fraction is more than 20%, there is a decrease in the hole expansion ratio (λ). Therefore, the area fraction of retained austenite is set to be 20% or less, preferably 18% or less, or more preferably 17% or less.

Area Fraction of Retained Austenite Grains Having Two or More Crystal Orientations in all Retained Austenite Grains: 40% or Less The expression "retained austenite grain having two or more crystal orientations" in accordance with aspects of the present invention denotes a grain formed by a combination of plural austenite sub-grains having a misorientation of 15° or more.

In accordance with aspects of the present invention, since the combination of retained austenite sub-grains is significantly important, austenite grains having two or more crystal orientations in all the retained austenite grains transform into martensite in the early stage of forming, which results in a deterioration in workability. To achieve the excellent workability according to aspects of the present invention, it is necessary that the area fraction of retained austenite grains having two or more crystal orientations in all the retained austenite grains be 40% or less, preferably 35% or less, preferably 30% or less, or even more preferably 20% or less.

Method for Determining Area Fractions of Martensite, Pearlite, Tempered Martensite, and Carbide-Containing Bainite In accordance with aspects of the present invention, the expression "area fractions of martensite, pearlite, tempered martensite, and carbide-containing bainite" denotes the area fractions of these phases, where the area fraction of each of these phases is defined as the ratio of the area of a respective one of these phases to the area of an observed field of view.

A sample is taken from the annealed steel sheet, the thickness cross section parallel to the rolling direction of the sample is polished, the polished cross section is etched by using a 3 vol % nital solution, and photographs of three fields of view in a region from a position located 300 μm from the steel sheet surface to a position located 400 μm from the steel sheet surface, where the distance is measured in the thickness direction, are taken by using a scanning electron microscope (SEM) at a magnification of 1500 times. Here, the expression "steel sheet surface" denotes the interface between the galvanized layer and the base steel sheet. The obtained image data are analyzed by using Image-Pro produced by Media Cybernetics, Inc. to determine the area fraction of each of the phases, and the average area fraction of each of the phases in three fields of view is defined as the area fraction of the respective one of the phases. In the image data described above, martensite is identified as a white or light gray phase, or a gray phase containing randomly oriented carbides, carbide-containing bainite is identified as a gray or dark gray phase containing uniformly oriented carbides, tempered martensite is identified as a gray or dark gray phase containing randomly oriented carbides, and pearlite is identified as a black and white lamellar phase.

Retained austenite, like martensite, has a white or light gray appearance. The area fraction of retained austenite is determined by performing electron back scatter diffraction (EBSD) analysis, and the area fraction of martensite is derived by subtracting the area fraction of retained austenite, which has been determined on the basis of EBSD, from the total area fraction of martensite and retained austenite, which has been determined by performing the image analysis described above.

Remaining phases other than those described above include ferrite and non-carbide-containing bainite. Ferrite is identified as a black phase, and non-carbide-containing bainite is identified as a dark gray phase. Although these remaining phases are not preferable, in accordance with aspects of the present invention, it is acceptable that the total area fraction of ferrite and non-carbide-containing bainite be 45% or less, preferably 40% or less, more preferably 35% or less, even more preferably 20% or less, or particularly preferably 10% or less.

A method for determining the area fraction of retained austenite on the basis of EBSD will be described. The surface which has been observed by using a SEM is polished again, the polished surface is subjected to mirror polishing utilizing colloidal silica, the three fields of view which have been observed by using a SEM are subjected to EBSD observation. The observation is performed at intervals of 50 nm on 1 million (1000×1000) points. The obtained data are subjected to Grain Dilation processing with threshold values of 5° and 2 pixels and to Neighbor CI Correlation processing with a threshold value of 0.1 by using OIM Analysis 6 produced by TSL Solutions, and the area fraction of an FCC phase, which corresponds to retained austenite, is derived from the processed data.

Method for Observing Retained Austenite Grains Having Two or More Crystal Orientations in all Retained Austenite Grains From the data which have been subjected to Grain Dilation processing and Neighbor CI Correlation processing in the method for determining the area fraction of retained austenite on the basis of EBSD as described above, the area fraction of grains formed by a combination of plural austenite sub-grains having a misorientation of 15° or more is derived. Then, the ratio (%) of the derived area fraction of the grains formed by a combination of plural austenite sub-grains having a misorientation of 15° or more to the area fraction of all the austenite grains is derived. The derived ratio (%) is defined as the area fraction of retained austenite grains having two or more crystal orientations in all the retained austenite grains.

3) Galvanized Layer

The high-strength galvanized steel sheet according to aspects of the present invention has a galvanized layer on the surface of a base steel sheet. The galvanized layer may be a galvannealing layer.

4) Steel Sheet Thickness

Although there is no particular limitation on the thickness of the high-strength galvanized steel sheet according to aspects of the present invention (thickness without a galvanized layer), it is preferable that the thickness be 0.4 mm or more and 3.0 mm or less.

5) Method for Manufacturing Galvanized Steel Sheet

The high-strength galvanized steel sheet according to aspects of the present invention is manufactured, for example, by performing a hot rolling process of performing hot rolling a slab having the chemical composition described above thereafter cooling and coiling, by holding the hot-rolled steel sheet, which has been obtained in the hot rolling process, or a cold-rolled steel sheet, which has been obtained by performing cold rolling the hot-rolled steel sheet with a rolling reduction ratio of 30% or more, in a temperature range from (Ac1−5° C.) to (Ac1+10° C.) for 15 s or more while applying a tension of 0 MPa (not inclusive) to 10 MPa, by heating the held steel sheet to an annealing temperature of 750° C. to 940° C. and holding the steel sheet at the annealing temperature for 10 s to 600 s, by cooling the annealed steel sheet to a primary cooling stop temperature, which is from Ms to 550° C., under the condition in which cooling is performed at a primary average cooling rate of 3° C./s or higher in a temperature range from the annealing temperature to a temperature of 550° C., by holding the cooled steel sheet at a galvanizing treatment temperature, which is from Ms to 580° C., for 10 s to 300 s while performing a galvanizing treatment which is optionally followed by an alloying treatment of galvanized layer, by cooling the galvanized steel sheet to a secondary cooling stop temperature of 50° C. to 350° C. under the condition in which cooling is performed at a secondary average cooling rate of 50° C./s or higher in a temperature range from the galvanizing treatment temperature to a temperature of 350° C., by heating the cooled steel sheet to a reheating temperature which is higher than the secondary cooling stop temperature and which is within a range of 300° C. to 500° C., by holding the steel sheet at the reheating temperature for 1 s to 600 s, and by cooling the held steel sheet to room temperature. Here, each of the temperatures used when describing the manufacturing conditions always denotes the surface temperature of the steel sheet.

Hereafter, the above-mentioned manufacturing method will be described step by step.

Cold Rolling Reduction Ratio: 30% or More

The hot-rolled steel sheet, which has been obtained in the hot rolling process, is subjected to cold rolling as needed. In the case where cold rolling is performed, when the rolling reduction ratio is less than 30%, since there is an increase in the amount of retained austenite grains having two or more crystal orientations, it is not possible to form the steel microstructure according to aspects of the present invention. Therefore, the cold rolling reduction ratio is set to be 30% or more or preferably 35% or more. Although there is no particular limitation on the upper limit of the rolling reduction ratio, it is preferable that the rolling reduction ratio be 90% or less from the viewpoint of, for example, shape stability. In the case where cold rolling is not performed, since bainite transformation is promoted, there is a decrease in the amount of retained austenite grains having two or more crystal orientations. Here, in the case where the hot-rolled steel sheet is subjected to annealing, skin pass rolling may be performed with a rolling reduction ratio of 5% or less for shape correction.

Holding Time in a Temperature Range from (Ac1−5° C.) to (Ac1+10° C.): 15 s or More The hot-rolled steel sheet, which has been obtained in the hot rolling process, or the cold-rolled steel sheet, which has been obtained by performing cold rolling the hot-rolled steel sheet as described above, is held in a temperature range from (Ac1−5° C.) to (Ac1+10° C.) for 15 s or more. In the case where the holding time in this temperature range is less than 15 s, since there is an increase in the amount of retained austenite grains having two or more crystal orientations, it is not possible to form the steel microstructure according to aspects of the present invention. Therefore, the holding time in a temperature range from (Ac1−5° C.) to (Ac1+10° C.) is set to be 15 s or more or preferably 20 s or more. In addition, in the case where this holding time is increased, since the amount of retained austenite grains having two or more crystal orientations decreases, there is an increase in the effects according to aspects of the present invention. Therefore, there is no particular limitation on the upper limit of the holding time. Here, "Ac1" denotes the Ac1 transformation temperature.

Tension Applied in a Temperature Range from (Ac1−5° C.) to (Ac1+10° C.): 0 MPa (not Inclusive) to 10 MPa When the above-described hot-rolled steel sheet or cold-rolled steel sheet is held in a temperature range from (Ac1−5° C.) to (Ac1+10° C.) to form austenite, it is possible to decrease the amount of retained austenite grains having two or more crystal orientations by applying tension. Although the mechanism for this effect is not clear, it is considered that, for example, the formation of retained austenite grains having two or more crystal orientations is inhibited and subsequent bainite transformation is promoted. However, in the case where the tension is more than 10 MPa, there is no such effect. Therefore, the tension applied in a temperature range from (Ac1−5° C.) to (Ac1+10° C.) is set to be 0 MPa (not inclusive) to 10 MPa, preferably 0.5 MPa to 10 MPa, or more preferably 0.5 MPa to 5 MPa.

The tension is applied, for example, in the rolling direction (longitudinal direction) in a production line. Although there is no particular limitation on the method used for applying the tension, it is preferable that the tension be applied by using a method in which tension is applied between pinch rolls by controlling the circumferential velocities of the pinch rolls or a method in which tension is applied by bending the steel sheet by using rolls. Here, the direction in which the tension is applied is not limited to the rolling direction, and the tension may be applied, for example, in a direction intersecting with the rolling direction in the plane of the steel sheet surface.

Annealing Temperature: 750° C. to 940° C.

After the processes described above, the steel sheet is heated to an annealing temperature of 750° C. to 940° C. In the case where the annealing temperature is lower than 750° C., since a sufficient amount of austenite is not formed, it is not possible to form the steel microstructure according to aspects of the present invention. On the other hand, in the case where the annealing temperature is higher than 940° C., since there is an increase in the amount of retained austenite grains having two or more crystal orientations, it is not possible to form the steel microstructure according to aspects of the present invention. Therefore, the annealing temperature is set to be 750° C. to 940° C. or preferably 770° C. to 920° C.

Holding Time at Annealing Temperature: 10 s to 600 s

The steel sheet is held at the annealing temperature described above for 10 s to 600 s. In the case where the holding time is less than 10 s, since a sufficient amount of austenite is not formed, it is not possible to form the steel microstructure according to aspects of the present invention. On the other hand, in the case where the holding time at the annealing temperature described above is more than 600 s, since there is an increase in the amount of retained austenite grains having two or more crystal orientations, it is not possible to form the steel microstructure according to aspects of the present invention. Therefore, the holding time is set to be 10 s to 600 s or preferably 30 s to 300 s.

Primary Average Cooling Rate in Temperature Range from Annealing Temperature to a Temperature of 550° C.: 3° C./s or Higher The steel sheet which has been subjected to annealing at the annealing temperature described above is cooled from the annealing temperature to a temperature of 550° C. or lower under the condition in which cooling is performed at a primary average cooling rate of 3° C./s or higher in a temperature range from the annealing temperature to a temperature of 550° C. The primary average cooling rate is calculated by dividing the difference between the annealing temperature and a temperature of 550° C. by the time required for cooling from the annealing temperature to a temperature of 550° C. In the case where the primary average cooling rate is lower than 3° C./s, since an excessive amount of ferrite is formed, it is not possible to form the steel microstructure according to aspects of the present invention. Therefore, the primary average cooling rate is set to be 3° C./s or higher or preferably 5° C./s or higher. Although there is no particular limitation on the upper limit of the primary average cooling rate, it is preferable that the primary average cooling rate be lower than 100° C./s from the viewpoint of shape stability.

Primary cooling stop temperature, which is from Ms to 550° C.

The primary cooling stop temperature is from Ms to 550° C. when the annealed steel sheet is cooled at the primary average cooling rate described above. Here, "Ms" denotes the Ms temperature (martensite transformation start temperature) of a steel sheet. In the case where the primary cooling stop temperature is lower than the Ms temperature, since pearlite is formed due to excessive C concentration in austenite before a galvanizing treatment is performed, it is not possible to form the steel microstructure according to aspects of the present invention. On the other hand, the primary cooling stop temperature is higher than 550° C., since excessive amounts of ferrite and pearlite are formed, it is not possible to form the steel microstructure according to aspects of the present invention. Therefore, the primary cooling stop temperature is set to be from Ms to 550° C. or preferably 450° C. to 550° C.

Holding Time at a Galvanizing Treatment Temperature, which is from Ms to 580° C., for 10 s to 300 s The steel sheet which has been cooled to the primary cooling stop temperature is held at a galvanizing treatment temperature, which is from Ms to 580° C. In the case where the holding time at a temperature, which is from Ms to 580° C., is less than 10 s or more than 300 s, since there is an increase in the amount of retained austenite grains having two or more crystal orientations due to insufficient progression of bainite transformation, it is not possible to form the steel microstructure according to aspects of the present invention. Therefore, the holding time at a galvanizing treatment temperature, which is from Ms to 580° C., is set to be 10 s to 300 s. Here, the galvanizing treatment temperature should be from Ms to 580° C., and heating may be performed to a temperature equal to or higher than the primary cooling stop temperature as needed after cooling has been performed at the primary average cooling rate described above.

Galvanizing Treatment

While the steel sheet is held at the galvanizing treatment temperature described above, the steel sheet is subjected to galvanizing treatment which is optionally followed by an alloying treatment of galvanized layer. In a galvanizing treatment, it is preferable that the steel sheet, which has been obtained as described above, be dipped in a galvanizing bath having a temperature of 440° C. or higher and 500° C. or lower and that the coating weight be thereafter adjusted by performing, for example, gas wiping. In the case where an alloying treatment is further performed on the galvanized layer, it is preferable that an alloying treatment be performed by holding the galvanized steel sheet in a temperature range of 460° C. or higher and 580° C. or lower for 1 s or more and 120 s or less. It is preferable that a galvanized layer be formed by using a galvanizing bath containing Al in an amount of 0.08 mass % or more and 0.25 mass % or less.

In addition, the galvanized steel sheet may also be subjected to various kinds of coating such as resin coating or oil and grease coating.

Secondary Average Cooling Rate in Temperature Range from Galvanizing Treatment Temperature to a Temperature of 350° C.: 50° C./s or Higher The galvanized steel sheet is cooled from the galvanizing treatment temperature to a temperature of 350° C. under the condition in which cooling is performed at a secondary average cooling rate of 50° C./s or higher in a temperature range from the galvanizing treatment temperature to a temperature of 350° C. or lower. The secondary average cooling rate is calculated by dividing the difference between the galvanizing treatment temperature and a temperature of 350° C. by the time required for cooling from the galvanizing treatment temperature to a temperature of 350° C. In the case where the secondary average cooling rate is less than 50° C./s, since bainite transformation is not sufficiently promoted, it is not possible to form the steel microstructure according to aspects of the present invention. Therefore, the secondary average cooling rate is set to be 50° C./s or higher. Since it is not necessary to put a particular limitation on the upper limit of the secondary average cooling rate as long as the secondary average cooling rate is 50° C./s or higher from the viewpoint of forming the steel microstructure according to aspects of the present invention, there is no particular limitation on the upper limit of the secondary average cooling rate. However, the industrially applicable upper limit of the secondary average cooling rate is about 1500° C./s.

Secondary Cooling Stop Temperature: 50° C. to 350° C.

The secondary cooling stop temperature is 50° C. to 350° C. when the galvanized steel sheet is cooled at the secondary average cooling rate described above. In the case where the secondary cooling stop temperature is lower than 50° C., it is not possible to form the retained austenite according to aspects of the present invention. On the other hand, in the case where the secondary cooling stop temperature is higher than 350° C., since bainite transformation is not sufficiently promoted, it is not possible to form the steel microstructure according to aspects of the present invention. Therefore, the secondary cooling stop temperature is set to be 50° C. to 350° C. or preferably 80° C. to 320° C.

Reheating Temperature: Higher than Secondary Cooling Stop Temperature and within a Range of 300° C. to 500° C.

The steel sheet which has been cooled to the secondary cooling stop temperature is heated at a reheating temperature which is higher than the secondary cooling stop temperature and which is within a range of 300° C. to 500° C. In the case where the reheating temperature is lower than 300° C., since there is an increase in the amount of retained austenite grains having two or more crystal orientations due to bainite transformation being inhibited, it is not possible to form the steel microstructure according to aspects of the present invention. On the other hand, in the case where the reheating temperature is higher than 500° C., since pearlite is formed, it is not possible to form the steel microstructure according to aspects of the present invention. Therefore, the reheating temperature is set to be 300° C. to 500° C. or preferably 325° C. to 475° C.

Holding Time at Reheating Temperature: 1 s to 600 s

The steel sheet which has been cooled to the secondary cooling stop temperature is held at the reheating temperature described above for 1 s to 600 s. In the case where the holding time is less than 1 s, since there is an increase in the amount of martensite grains and retained austenite grains having two or more crystal orientations due to insufficient bainite transformation, it is not possible to form the steel microstructure according to aspects of the present invention. On the other hand, in the case where the holding time is more than 600 s, since pearlite is formed, it is not possible to form the steel microstructure according to aspects of the present invention. Therefore, the holding time at the reheating temperature is set to be 1 s to 600 s, preferably 1 s to 300 s, more preferably 1 s to 120 s, or even more preferably 1 s to 60 s.

In the case of the method for manufacturing the high-strength galvanized steel sheet according to aspects of the present invention, although there is no particular limitation on the method used for manufacturing a slab or conditions applied for a hot rolling process, it is preferable that, for example, the following conditions be applied.

Method for Manufacturing Slab

Although it is preferable that a slab be manufactured by using a continuous casting method to prevent macro segregation, an ingot-making method or a thin-slab casting method may be used. When a slab is subjected to hot rolling, a method in which the slab is first cooled to room temperature and then reheated before hot rolling is performed or a method in which the slab that has not been cooled to room temperature is charged into a heating furnace before hot rolling is performed may be used. In addition, an energy-saving process, in which the slab is subjected to hot rolling immediately after heat retention has been performed for a short time, may also be used.

In the case where the slab is heated, it is preferable that the slab be heated to a temperature of 1100° C. or higher to dissolve carbides and to prevent an increase in rolling load. In addition, it is preferable that the slab heating temperature be 1300° C. or lower to prevent an increase in scale loss. Here, the expression "temperature of a slab" denotes the surface temperature of the slab.

Although there is no particular limitation on the conditions applied for a finishing delivery temperature, it is preferable that the finishing delivery temperature be 800° C. to 950° C. from the viewpoint of easily forming the steel sheet microstructure according to aspects of the present invention and of homogenizing the steel sheet microstructure.

When the slab is subjected to hot rolling, a sheet bar, which has been obtained by performing rough rolling on the slab, may be heated. In addition, so-called a continuous rolling process, in which sheet bars are joined so that finish rolling is continuously performed, may be used. In addition, in hot rolling, it is preferable that lubricated rolling, in which rolling is performed with a frictional coefficient of 0.10 to 0.25, be performed at all or some of the finish rolling stands to decrease rolling load and to homogenize a shape and material properties.

Although there is no particular limitation on the coiling temperature for the steel sheet after hot rolling has been performed, it is preferable that the coiling temperature be 400° C. to 550° C. from the viewpoint of easily forming the steel sheet microstructure according to aspects of the present invention and of stabilizing the shape of the steel sheet.

The steel sheet which has been subjected to coiling may be subjected to subsequent processes after having been subjected to descaling by performing, for example, pickling.

In addition, in the case of the method for manufacturing the high-strength galvanized steel sheet according to aspects of the present invention, skin pass rolling may further be performed after a galvanizing treatment has been performed. In the case where skin pass rolling is performed, it is preferable that the elongation ratio be 0.05% or more and 1.00% or less from the viewpoint of improving YS to a higher level. It is preferable that skin pass rolling be performed at room temperature after heat treatment has been performed.

EXAMPLES

Hereafter, the present invention will be specifically described in accordance with examples. The technical scope of the present invention is not limited to the examples below.

Molten steels having the chemical compositions (with a balance of Fe and inevitable impurities) given in Table 1 were prepared by using a vacuum melting furnace in a laboratory and subjected to rolling to obtain steel slabs. These steel slabs were subjected to heating to a temperature of 1250° C. followed by rough rolling and thereafter subjected to hot rolling under the hot rolling conditions given in Table 2-1 or Table 2-2 to obtain hot-rolled steel sheets. Subsequently, some of the samples of the hot-rolled steel sheets were subjected to cold rolling under the cold rolling conditions given in Table 2-1 or Table 2-2 to obtain cold-rolled steel sheets having a thickness of 1.4 mm. Subsequently, the obtained hot-rolled steel sheets or cold-rolled steel sheets were subjected to annealing. Here, in the case of the steel sheets indicated by "—" in the column "Cold Rolling Condition" in Table 2-1 and Table 2-2, cold rolling was not performed, and the hot-rolled steel sheets were subjected to annealing. The Ac1 transformation temperatures (° C.) are also given in Table 1.

Annealing was performed by using a heat treatment-galvanizing treatment apparatus in a laboratory under the proper annealing conditions given in Table 2-1 or Table 2-2 to manufacture galvannealed steel sheets (GA) 1 through 39. The galvannealed steel sheets were manufactured by dipping the steel sheets in a galvanizing bath having a temperature of 465° C. to form a galvanized layer with a coating weight of 40 g/m$^2$ to 60 g/m$^2$ per side on both surfaces of the steel sheets and by thereafter holding the galvanized steel sheets at a temperature of 540° C. for 1 s to 60 s to perform an alloying treatment on the galvanized layer. After a heat treatment had been performed (after holding had been performed at reheating temperatures given in Table 2-1 or Table 2-2), the steel sheets were subjected to skin pass rolling with an elongation ratio of 0.1%.

The tensile properties and workability of the obtained galvannealed steel sheet were evaluated by using the methods described below. The results are given in Table 3. In addition, the area fraction of each of the phases in a region from a position located 300 μm from the steel sheet surface to a position located 400 μm from the steel sheet surface and the area fraction of retained austenite grains having two or more crystal orientations in all the retained austenite grains in a region from a position located 300 μm from the steel sheet surface to a position located 400 μm from the steel sheet surface are also given in Table 3.

<Determining Area Fraction of Each Phase>

A sample was taken from each of the steel sheets, the thickness cross section parallel to the rolling direction of the sample was polished, the polished cross section was etched by using a 3 vol % nital solution, and photographs of three fields of view in a region from a position located 300 μm from the steel sheet surface to a position located 400 μm from the steel sheet surface, where the distance is measured in the thickness direction, were taken by using a scanning electron microscope (SEM) at a magnification of 1500 times. Here, the expression "steel sheet surface" denotes the interface between the galvanized layer and the base steel sheet. The obtained image data were analyzed by using Image-Pro produced by Media Cybernetics, Inc. to determine the area fraction of each of the phases, and the average area fraction of each of the phases in three fields of view was defined as the area fraction of the respective one of the phases. In the image data described above, martensite is identified as a white or light gray phase, or a gray phase containing randomly oriented carbides, carbide-containing bainite is identified as a gray or dark gray phase containing uniformly oriented carbides, tempered martensite is identified as a gray or dark gray phase containing randomly oriented carbides, pearlite is identified as a black and white layered phase, ferrite is identified as a black phase, and non-carbide-containing bainite is identified as a dark gray phase.

In addition, retained austenite, like martensite, has a white or light gray appearance. Here, the area fraction of martensite was derived by subtracting the area fraction of retained austenite, which had been determined on the basis of electron back scatter diffraction (EBSD), from the total area fraction of martensite and retained austenite, which had been determined by performing the image analysis described above.

A method for determining the area fraction of retained austenite on the basis of EBSD will be described. The surface which has been observed by using a SEM was polished again, the polished surface was subjected to mirror polishing utilizing colloidal silica, the three fields of view which had been observed by using a SEM were subjected to EBSD observation. The observation was performed at intervals of 50 nm on 1 million (1000×1000) points. The obtained data were subjected to Grain Dilation processing with threshold values of 5° and 2 pixels and to Neighbor CI Correlation processing with a threshold value of 0.1 by using OIM Analysis 6 produced by TSL Solutions, and the area fraction of an FCC phase, which corresponds to retained austenite, was derived from the processed data.

<Method for Observing Retained Austenite Grains Having Two or More Crystal Orientations in all Retained Austenite Grains>

From the data which had been subjected to Grain Dilation processing and Neighbor CI Correlation processing in the method for determining the area fraction of retained austenite on the basis of EBSD as described above, the area fraction of grains formed by a combination of plural austenite sub-grains having a misorientation of 15° or more was derived. Then, the ratio (%) of the derived area fraction of the grains formed by a combination of plural austenite sub-grains having a misorientation of 15° or more to the area fraction of all the austenite grains was derived. The derived ratio (%) was defined as the area fraction of retained austenite grains having two or more crystal orientations in all the retained austenite grains.

<Tensile Test>

A JIS No. 5 tensile test (JIS Z 2201) piece was taken from the obtained galvanized steel sheet so that the tensile direction was perpendicular to the rolling direction, and a tensile test was performed with a strain rate of $10^{-3}$/s in accordance with JIS Z 2241 (2011) to obtain the YS and the uniform elongation (UEL). In accordance with aspects of the present invention, a case where the YS was 850 MPa or more and the uniform elongation was 9.0% or more was determined as satisfactory.

<Hole Expansion Test>

A test piece having a size of 100 mm×100 mm was taken from the obtained galvanized steel sheet, a hole expansion test was performed 3 times by using a conical punch having a point angle of 60° in accordance with JFS T 1001 (The Japan Iron and Steel Federation Standard, 2008) to obtain an average hole expansion ratio λ (%), and the stretch flange formability was evaluated. In accordance with aspects of the present invention, a case where (YS×(uniform elongation (UEL))×(hole expansion ratio λ)) was 270 GPa·%·% or more was determined as a case of excellent workability, that is, satisfactory.

TABLE 1

| | Chemical Composition (mass %) | | | | | | | Ac1 Transformation Temperature | |
|---|---|---|---|---|---|---|---|---|---|
| Steel | C | Si | Mn | P | S | Al | Other | (° C.) | Note |
| A | 0.31 | 1.5 | 3.0 | 0.010 | 0.002 | 0.03 | — | 690 | within Scope of Invention |
| B | 0.27 | 1.5 | 3.0 | 0.010 | 0.002 | 0.03 | V: 0.1 | 691 | within Scope of Invention |
| C | 0.23 | 1.5 | 3.0 | 0.010 | 0.002 | 0.03 | Mo: 0.1 | 693 | within Scope of Invention |
| D | 0.18 | 1.5 | 3.0 | 0.010 | 0.002 | 0.03 | Ti: 0.02 | 693 | within Scope of Invention |
| E | 0.14 | 1.5 | 2.8 | 0.010 | 0.002 | 0.03 | Nb: 0.02 | 699 | within Scope of Invention |
| F | 0.20 | 1.0 | 3.0 | 0.010 | 0.002 | 0.60 | Ni: 0.2 | 587 | within Scope of Invention |
| G | 0.20 | 1.0 | 2.0 | 0.010 | 0.002 | 0.03 | Cr: 1.0 | 709 | within Scope of Invention |
| H | 0.20 | 0.7 | 3.5 | 0.010 | 0.002 | 0.80 | Cu: 0.2 | 536 | within Scope of Invention |
| I | 0.20 | 2.1 | 3.0 | 0.010 | 0.002 | 0.03 | B: 0.0025 | 703 | within Scope of Invention |

TABLE 1-continued

| Steel | Chemical Composition (mass %) C | Si | Mn | P | S | Al | Other | Ac1 Transformation Temperature (° C.) | Note |
|---|---|---|---|---|---|---|---|---|---|
| J | 0.20 | 1.5 | 3.0 | 0.010 | 0.002 | 0.03 | Ca: 0.003 | 693 | within Scope of Invention |
| K | 0.20 | 1.5 | 3.0 | 0.010 | 0.002 | 0.03 | REM: 0.002 | 693 | within Scope of Invention |
| L | 0.20 | 1.5 | 3.0 | 0.010 | 0.002 | 0.03 | Sn: 0.20 | 693 | within Scope of Invention |
| M | 0.20 | 1.5 | 3.0 | 0.010 | 0.002 | 0.03 | Sb: 0.02 | 693 | within Scope of Invention |
| N | 0.11 | 1.5 | 3.0 | 0.010 | 0.002 | 0.03 | — | 695 | outside Scope of Invention |
| O | 0.37 | 1.5 | 3.0 | 0.010 | 0.002 | 0.03 | — | 688 | outside Scope of Invention |
| P | 0.20 | 0.4 | 3.0 | 0.010 | 0.002 | 0.03 | — | 673 | outside Scope of Invention |
| Q | 0.20 | 3.3 | 3.0 | 0.010 | 0.002 | 0.03 | — | 725 | outside Scope of Invention |
| R | 0.20 | 1.5 | 1.4 | 0.010 | 0.002 | 0.03 | — | 733 | outside Scope of Invention |
| S | 0.20 | 1.5 | 4.2 | 0.010 | 0.002 | 0.03 | — | 663 | outside Scope of Invention |
| T | 0.20 | 1.5 | 2.8 | 0.010 | 0.002 | 0.03 | V: 0.4 | 698 | within Scope of Invention |
| U | 0.15 | 1.5 | 2.9 | 0.010 | 0.002 | 0.03 | Mo: 0.5 | 706 | within Scope of Invention |

TABLE 2-1

| Steel Sheet No. | Steel | Hot Rolling Condition: Finishing Delivery Temperature (° C.) | Hot Rolling Condition: Coiling Temperature (° C.) | Cold Rolling Condition: Cold Rolling Reduction Ratio (%) | Annealing Condition: *1 (s) | *2 (MPa) | Annealing Temperature (° C.) | Annealing Time *9 (s) | *3 (° C./s) |
|---|---|---|---|---|---|---|---|---|---|
| 1 | A | 920 | 550 | 50 | 30 | 1 | 850 | 100 | 30 |
| 2 | | 920 | 550 | 25 | 30 | 1 | 850 | 100 | 30 |
| 3 | | 920 | 550 | 50 | 10 | 1 | 850 | 100 | 30 |
| 4 | B | 900 | 500 | — | 30 | 1 | 880 | 100 | 30 |
| 5 | | 900 | 500 | — | 30 | 0 | 880 | 100 | 30 |
| 6 | | 900 | 500 | — | 30 | 12 | 880 | 100 | 30 |
| 7 | C | 850 | 500 | 50 | 30 | 3 | 900 | 100 | 8 |
| 8 | | 850 | 500 | 50 | 30 | 3 | 740 | 100 | 8 |
| 9 | | 850 | 500 | 50 | 30 | 3 | 960 | 100 | 8 |
| 10 | D | 900 | 500 | 50 | 30 | 6 | 850 | 100 | 30 |
| 11 | | 900 | 500 | 50 | 30 | 6 | 850 | 8 | 30 |
| 12 | | 900 | 500 | 50 | 30 | 6 | 850 | 800 | 30 |
| 13 | E | 900 | 450 | 50 | 30 | 1 | 800 | 100 | 30 |
| 14 | | 900 | 450 | 50 | 30 | 1 | 800 | 100 | 1 |
| 15 | | 900 | 450 | 50 | 30 | 1 | 800 | 100 | 30 |
| 16 | | 900 | 450 | 50 | 30 | 1 | 790 | 100 | 30 |
| 17 | F | 900 | 400 | 50 | 30 | 1 | 900 | 100 | 30 |
| 18 | | 900 | 400 | 50 | 30 | 1 | 900 | 100 | 30 |
| 19 | | 900 | 400 | 50 | 30 | 1 | 900 | 100 | 30 |
| 20 | G | 900 | 500 | 35 | 30 | 1 | 850 | 100 | 30 |
| 21 | | 900 | 500 | 35 | 30 | 1 | 850 | 100 | 30 |
| 22 | | 900 | 500 | 35 | 30 | 1 | 850 | 100 | 30 |

| Steel Sheet No. | Annealing Condition: *4 (° C.) | *5 (s) | *6 (° C./s) | *7 (° C.) | Reheating Temperature (° C.) | *8 (s) | Ms (° C.) | Note |
|---|---|---|---|---|---|---|---|---|
| 1 | 400 | 200 | 50 | 200 | 400 | 500 | 305 | Example |
| 2 | 400 | 200 | 50 | 200 | 400 | 500 | 302 | Comparative Example |
| 3 | 400 | 200 | 50 | 200 | 400 | 500 | 305 | Comparative Example |
| 4 | 500 | 200 | 1000 | 200 | 370 | 120 | 320 | Example |
| 5 | 500 | 200 | 1000 | 200 | 370 | 120 | 323 | Comparative Example |
| 6 | 500 | 200 | 1000 | 200 | 370 | 120 | 321 | Comparative Example |
| 7 | 500 | 200 | 1000 | 250 | 400 | 10 | 344 | Example |
| 8 | 500 | 200 | 1000 | 250 | 400 | 10 | 263 | Comparative Example |
| 9 | 500 | 200 | 1000 | 250 | 400 | 10 | 342 | Comparative Example |
| 10 | 500 | 100 | 1000 | 300 | 480 | 1 | 365 | Example |
| 11 | 500 | 100 | 1000 | 300 | 480 | 1 | 317 | Comparative Example |
| 12 | 500 | 100 | 1000 | 300 | 480 | 1 | 365 | Comparative Example |
| 13 | 500 | 100 | 1000 | 250 | 350 | 10 | 334 | Example |
| 14 | 500 | 100 | 1000 | 250 | 350 | 10 | 285 | Comparative Example |
| 15 | 600 | 100 | 1000 | 250 | 350 | 10 | 288 | Comparative Example |
| 16 | 500 | 100 | 1000 | 200 | 440 | 30 | 260 | Example |
| 17 | 500 | 100 | 100 | 250 | 400 | 10 | 328 | Example |
| 18 | 300 | 100 | 100 | 250 | 400 | 10 | 328 | Comparative Example |
| 19 | 500 | 5 | 100 | 250 | 400 | 10 | 330 | Comparative Example |

TABLE 2-1-continued

| | | | | | | | | |
|---|---|---|---|---|---|---|---|---|
| 20 | 500 | 50 | 1000 | 280 | 400 | 10 | 393 | Example |
| 21 | 500 | 350 | 1000 | 280 | 400 | 10 | 390 | Comparative Example |
| 22 | 500 | 50 | 30 | 280 | 400 | 10 | 389 | Comparative Example |

*1: holding time in a temperature range from (Ac1 − 5° C.) to (Ac1 + 10° C.)

*2: tension applied in a temperature range from (Ac1 − 5° C.) to (Ac1 + 10° C.)

*3: primary average cooling rate in a temperature range from the annealing temperature to a temperature of 550° C.

*4: primary cooling stop temperature

*5: holding time at the galvanizing treatment temperature (from Ms to 580° C.)

*6: secondary average cooling rate in a temperature range from the galvanizing treatment temperature to a temperature of 350° C.

*7: secondary cooling stop temperature

*8: holding time at the reheating temperature

*9: holding time at the annealing temperature

TABLE 2-2

| | | Hot Rolling Condition | | Cold Rolling Condition | Annealing Condition | | | | |
|---|---|---|---|---|---|---|---|---|---|
| Steel Sheet No. | Steel | Finishing Delivery Temperature (° C.) | Coiling Temperature (° C.) | Cold Rolling Reduction Ratio (%) | *1 (s) | *2 (MPa) | Annealing Temperature (° C.) | Annealing Time *9 (s) | *3 (° C./s) |
| 23 | H | 900 | 500 | 70 | 30 | 1 | 920 | 100 | 30 |
| 24 | | 900 | 500 | 70 | 30 | 1 | 920 | 100 | 30 |
| 25 | | 900 | 500 | 70 | 30 | 1 | 920 | 100 | 30 |
| 26 | I | 820 | 500 | 50 | 30 | 1 | 850 | 100 | 4 |
| 27 | | 820 | 500 | 50 | 30 | 1 | 850 | 100 | 4 |
| 28 | | 820 | 500 | 50 | 30 | 1 | 850 | 100 | 4 |
| 29 | J | 900 | 500 | 50 | 30 | 1 | 850 | 100 | 30 |
| 30 | | 900 | 500 | 50 | 30 | 1 | 850 | 100 | 30 |
| 31 | | 900 | 500 | 50 | 30 | 1 | 850 | 100 | 30 |
| 32 | | 900 | 500 | 50 | 30 | 1 | 920 | 100 | 30 |
| 33 | | 900 | 500 | 50 | 30 | 1 | 850 | 100 | 30 |
| 34 | K | 900 | 500 | 50 | 30 | 1 | 850 | 100 | 30 |
| 35 | L | 900 | 500 | 50 | 30 | 1 | 800 | 100 | 30 |
| 36 | M | 900 | 500 | 50 | 30 | 1 | 850 | 100 | 30 |
| 37 | N | 900 | 500 | 50 | 30 | 1 | 850 | 100 | 30 |
| 38 | O | 900 | 500 | 50 | 30 | 1 | 850 | 100 | 30 |
| 39 | P | 900 | 500 | 50 | 30 | 1 | 850 | 100 | 30 |
| 40 | Q | 900 | 500 | 50 | 30 | 1 | 850 | 100 | 30 |
| 41 | R | 900 | 500 | 50 | 30 | 1 | 850 | 100 | 30 |
| 42 | S | 900 | 500 | 50 | 30 | 1 | 850 | 100 | 30 |
| 43 | T | 900 | 500 | 50 | 30 | 1 | 930 | 400 | 30 |
| 44 | U | 900 | 500 | 50 | 30 | 1 | 920 | 400 | 30 |

| | Annealing Condition | | | | | | | |
|---|---|---|---|---|---|---|---|---|
| Steel Sheet No. | *4 (° C.) | *5 (s) | *6 (° C./s) | *7 (° C.) | Reheating Temperature (° C.) | *8 (s) | Ms (° C.) | Note |
| 23 | 500 | 30 | 1000 | 200 | 400 | 10 | 320 | Example |
| 24 | 500 | 30 | 1000 | 25 | 400 | 10 | 318 | Comparative Example |
| 25 | 500 | 30 | 1000 | 380 | 400 | 10 | 322 | Comparative Example |
| 26 | 540 | 100 | 1000 | 200 | 330 | 10 | 315 | Example |
| 27 | 540 | 100 | 1000 | 200 | 280 | 10 | 318 | Comparative Example |
| 28 | 540 | 100 | 1000 | 200 | 530 | 10 | 305 | Comparative Example |
| 29 | 500 | 100 | 1000 | 300 | 420 | 300 | 355 | Example |
| 30 | 500 | 100 | 1000 | 300 | 420 | 0.1 | 355 | Comparative Example |
| 31 | 500 | 100 | 1000 | 300 | 420 | 800 | 352 | Comparative Example |
| 32 | 500 | 100 | 1000 | 300 | 400 | 30 | 352 | Example |
| 33 | 500 | 100 | 1000 | 230 | 430 | 60 | 352 | Example |
| 34 | 500 | 100 | 1000 | 300 | 400 | 10 | 355 | Example |
| 35 | 500 | 100 | 1000 | 300 | 400 | 10 | 358 | Example |
| 36 | 500 | 100 | 1000 | 300 | 400 | 10 | 352 | Example |
| 37 | 500 | 100 | 1000 | 300 | 400 | 10 | 399 | Comparative Example |
| 38 | 500 | 100 | 1000 | 200 | 400 | 10 | 275 | Comparative Example |
| 39 | 500 | 100 | 1000 | 200 | 400 | 10 | 364 | Comparative Example |
| 40 | 500 | 100 | 1000 | 200 | 400 | 10 | 252 | Comparative Example |

TABLE 2-2-continued

| | | | | | | | | |
|---|---|---|---|---|---|---|---|---|
| 41 | 500 | 100 | 1000 | 250 | 400 | 10 | 278 | Comparative Example |
| 42 | 500 | 100 | 1000 | 250 | 400 | 10 | 316 | Comparative Example |
| 43 | 500 | 150 | 1000 | 320 | 400 | 300 | 363 | Example |
| 44 | 500 | 100 | 1000 | 350 | 400 | 500 | 378 | Example |

*1: holding time in a temperature range from (Ac1 − 5° C.) to (Ac1 + 10° C.)
*2: tension applied in a temperature range from (Ac1 − 5° C.) to (Ac1 + 10° C.)
*3: primary average cooling rate in a temperature range from the annealing temperature to a temperature of 550° C.
*4: primary cooling stop temperature
*5: holding time at the galvanizing treatment temperature (from Ms to 580° C.)
*6: secondary average cooling rate in a temperature range from the galvanizing treatment temperature to a temperature of 350° C.
*7: secondary cooling stop temperature
*8: holding time at the reheating temperature
*9: holding time at the annealing temperature

TABLE 3

| Steel | Steel Microstructure | | | | | | | | | | |
|---|---|---|---|---|---|---|---|---|---|---|---|
| | Steel Microstructure | | | | | | Tensile Property | | Hole Expansion | Workability YS × UEL × | |
| Sheet No. | V(M) (%) | V(P) (%) | V(H) (%) | V(γ) (%) | V(O) (%) | V(γ2/γ) (%) | YS (MPa) | UEL (%) | Formability λ (%) | λ (GPa · % · %) | Note |
| 1 | 5 | 0 | 73 | 15 | 7 | 20 | 1256 | 10.5 | 25 | 330 | Example |
| 2 | 5 | 0 | 73 | 15 | 7 | 56 | 1229 | 8.7 | 22 | 235 | Comparative Example |
| 3 | 5 | 0 | 72 | 16 | 7 | 51 | 1242 | 8.8 | 23 | 251 | Comparative Example |
| 4 | 3 | 0 | 79 | 11 | 7 | 16 | 1215 | 10.1 | 27 | 331 | Example |
| 5 | 3 | 0 | 75 | 10 | 12 | 44 | 1188 | 8.8 | 24 | 251 | Comparative Example |
| 6 | 3 | 0 | 74 | 11 | 12 | 43 | 1186 | 8.7 | 24 | 248 | Comparative Example |
| 7 | 7 | 0 | 66 | 17 | 10 | 16 | 1125 | 9.9 | 35 | 390 | Example |
| 8 | 34 | 0 | 4 | 20 | 42 | 28 | 809 | 10.3 | 5 | 42 | Comparative Example |
| 9 | 7 | 0 | 68 | 16 | 9 | 41 | 1116 | 9.1 | 26 | 264 | Comparative Example |
| 10 | 6 | 0 | 55 | 12 | 27 | 19 | 970 | 11.2 | 42 | 456 | Example |
| 11 | 30 | 0 | 10 | 17 | 43 | 25 | 792 | 11.2 | 6 | 53 | Comparative Example |
| 12 | 7 | 0 | 54 | 12 | 27 | 44 | 931 | 10.2 | 28 | 266 | Comparative Example |
| 13 | 2 | 0 | 58 | 9 | 31 | 13 | 904 | 12.0 | 35 | 380 | Example |
| 14 | 19 | 0 | 29 | 10 | 42 | 20 | 788 | 10.7 | 12 | 101 | Comparative Example |
| 15 | 18 | 0 | 28 | 10 | 44 | 20 | 794 | 10.5 | 14 | 117 | Comparative Example |
| 16 | 2 | 0 | 59 | 4 | 35 | 13 | 862 | 9.9 | 32 | 273 | Example |
| 17 | 3 | 0 | 43 | 16 | 38 | 24 | 907 | 12.4 | 34 | 382 | Example |
| 18 | 8 | 5 | 40 | 4 | 43 | 20 | 802 | 8.5 | 25 | 170 | Comparative Example |
| 19 | 9 | 0 | 39 | 18 | 34 | 47 | 855 | 8.9 | 24 | 183 | Comparative Example |
| 20 | 5 | 0 | 65 | 11 | 19 | 17 | 1005 | 10.6 | 40 | 426 | Example |
| 21 | 12 | 0 | 68 | 12 | 8 | 43 | 863 | 10.0 | 28 | 242 | Comparative Example |
| 22 | 11 | 0 | 67 | 12 | 10 | 43 | 871 | 10.1 | 27 | 238 | Comparative Example |
| 23 | 3 | 0 | 58 | 10 | 29 | 16 | 926 | 9.8 | 35 | 318 | Example |
| 24 | 0 | 0 | 79 | 0 | 21 | — | 1139 | 5.3 | 49 | 296 | Comparative Example |
| 25 | 62 | 0 | 0 | 15 | 23 | 60 | 874 | 8.8 | 10 | 77 | Comparative Example |
| 26 | 5 | 0 | 66 | 12 | 17 | 13 | 1106 | 11.8 | 38 | 496 | Example |
| 27 | 6 | 0 | 70 | 14 | 10 | 45 | 1121 | 8.5 | 28 | 267 | Comparative Example |
| 28 | 6 | 10 | 67 | 3 | 14 | 12 | 893 | 8.4 | 41 | 308 | Comparative Example |
| 29 | 7 | 0 | 48 | 13 | 32 | 17 | 982 | 10.6 | 40 | 416 | Example |
| 30 | 39 | 0 | 48 | 5 | 8 | 48 | 811 | 9.3 | 8 | 60 | Comparative Example |
| 31 | 8 | 12 | 49 | 1 | 30 | 13 | 820 | 8.4 | 31 | 214 | Comparative Example |
| 32 | 10 | 0 | 41 | 16 | 33 | 36 | 917 | 9.8 | 33 | 297 | Example |
| 33 | 3 | 0 | 91 | 6 | 0 | 13 | 1156 | 9.1 | 64 | 673 | Example |
| 34 | 6 | 0 | 50 | 12 | 32 | 16 | 993 | 10.5 | 40 | 417 | Example |
| 35 | 7 | 0 | 49 | 14 | 30 | 17 | 985 | 11.4 | 32 | 359 | Example |
| 36 | 6 | 0 | 49 | 12 | 33 | 17 | 999 | 10.3 | 45 | 463 | Example |
| 37 | 2 | 0 | 73 | 3 | 22 | 13 | 838 | 9.4 | 51 | 402 | Comparative Example |
| 38 | 12 | 0 | 62 | 22 | 4 | 35 | 1057 | 10.9 | 14 | 161 | Comparative Example |
| 39 | 3 | 0 | 85 | 0 | 12 | — | 1102 | 6.1 | 49 | 329 | Comparative Example |
| 40 | 18 | 0 | 28 | 8 | 46 | 21 | 842 | 11.0 | 10 | 93 | Comparative Example |
| 41 | 6 | 0 | 15 | 6 | 73 | 23 | 824 | 9.5 | 35 | 274 | Comparative Example |

TABLE 3-continued

| Steel | Steel Microstructure | | | | | | Tensile Property | | Hole Expansion | Workability YS × UEL × | |
|---|---|---|---|---|---|---|---|---|---|---|---|
| Sheet No. | V(M) (%) | V(P) (%) | V(H) (%) | V(γ) (%) | V(O) (%) | V(γ2/γ) (%) | YS (MPa) | UEL (%) | Formability λ (%) | λ (GPa · % · %) | Note |
| 42 | 12 | 0 | 55 | 8 | 25 | 37 | 1061 | 9.1 | 21 | 203 | Comparative Example |
| 43 | 8 | 0 | 40 | 10 | 42 | 35 | 880 | 11.1 | 32 | 313 | Example |
| 44 | 23 | 1 | 35 | 15 | 26 | 33 | 857 | 10.8 | 33 | 305 | Example |

V(M): area fraction of martensite
V(P): area fraction of pearlite
V(H): total area fraction of tempered martensite and carbide-containing bainite
V(γ):area fraction of retained austenite
V(O): total area fraction of ferrite and non-carbide-containing bainite
V(γ2/γ): area fraction of retained austenite grains having two or more crystal orientations in all the retained austenite grains
YS: yield strength,
UEL: uniform elongation,
λ: hole expansion ratio The galvanized steel sheets of the examples of the present invention had a YS of 850 MPa or more, a uniform elongation (UEL) of 9.0% or more, and a (YS×(uniform elongation (UEL))×(hole expansion ratio λ)) of 270 GPa·%·% or more, that is, high strength and excellent workability. On the other hand, the galvanized steel sheets of the comparative examples, which were out of the scope of the present invention, were unsatisfactory in terms of at least one of such criteria.

INDUSTRIAL APPLICABILITY

In the case where the high-strength steel sheet according to aspects of the present invention is used for automobile parts, the steel sheet significantly contributes to improving the collision safety and fuel efficiency of automobiles.

The invention claimed is:

1. A high-strength galvanized steel sheet comprising a base steel sheet and a galvanized layer on a surface of the base steel sheet, wherein the base steel sheet has a chemical composition containing, by mass %, C: 0.12% to 0.35%, Si: 0.5% to 3.0%, Mn: 1.5% to 4.0%, P: 0.100% or less (not including 0%), S: 0.02% or less (not including 0%), Al: 0.01% to 1.50%, with the balance being Fe and inevitable impurities, and wherein the base steel sheet has a microstructure in which an area fraction of martensite is 30% or less, an area fraction of pearlite is 1% or less, a total area fraction of tempered martensite and carbide-containing bainite is 30% or more and 99% or less, an area fraction of retained austenite is 1% to 20%, and a total area fraction of ferrite and non-carbide-containing bainite is 45% or less in the steel sheet microstructure in a region from a position located 300 μm from the steel sheet surface to a position located 400 μm from the steel sheet surface, and in which an area fraction of retained austenite grains having two or more crystal orientations is 13% or more and 40% or less in all the retained austenite grains in a region from a position located 300 μm from the steel sheet surface to a position located 400 μm from the steel sheet surface, where the retained austenite grains having two or more crystal orientations are grains formed by a combination of plural austenite sub-grains having a misorientation of 15° or more.

2. The high-strength galvanized steel sheet according to claim 1, wherein the base steel sheet has the chemical composition further containing, by mass %, at least one selected from Cr: 0.005% to 2.0%, Ni: 0.005% to 2.0%, Cu: 0.005% to 2.0%, V: 0.1% to 1.5%, Mo: 0.1% to 1.5%, Ti: 0.005% to 0.10%, Nb: 0.005% to 0.10%, B: 0.0001% to 0.0050%, Ca: 0.0003% to 0.0050%, REM: 0.0003% to 0.0050%, Sn: 0.005% to 0.50%, and Sb: 0.005% to 0.50%.

3. The high-strength galvanized steel sheet according to claim 2, wherein the galvanized layer is a galvannealed layer.

4. The high-strength galvanized steel sheet according to claim 1, wherein the galvanized layer is a galvannealed layer.

5. A method for manufacturing the high-strength galvanized steel sheet of claim 1, the method comprising:

performing a hot rolling process of performing hot rolling a slab to produce a hot-rolled steel sheet having chemical composition according to claim 1 thereafter cooling and coiling;

holding the hot-rolled steel sheet, which has been obtained in the hot rolling process, or a cold-rolled steel sheet, which has been obtained by further performing cold rolling the hot-rolled steel sheet with a rolling reduction ratio of 30% or more, in a temperature range from (Ac1−5° C.) to (Ac1+10° C.) for 15 s or more while applying a tension of 0 MPa (not inclusive) to 10 MPa;

heating the held steel sheet to an annealing temperature of 750° C. to 940° C. and holding the steel sheet at the annealing temperature for 10 s to 600 s;

cooling the annealed steel sheet to a primary cooling stop temperature, which is from Ms to 550° C., under a condition in which cooling is performed at a primary average cooling rate of 3° C./s or higher in a temperature range from the annealing temperature to a temperature of 550° C.;

holding the cooled steel sheet at a galvanizing treatment temperature, which is from Ms to 580° C., for 10 s to 300 s while performing a galvanizing treatment which is optionally followed by an alloying treatment of galvanized layer;

cooling the galvanized steel sheet to a secondary cooling stop temperature of 50° C. to 350° C. under a condition in which cooling is performed at a secondary average cooling rate of 50° C./s or higher in a temperature range from the galvanizing treatment temperature to a temperature of 350° C.; and heating the cooled steel sheet to a reheating temperature which is higher than the secondary cooling stop temperature and which is within a range of 300° C. to 500° C., holding the steel sheet at the reheating temperature for 1 s to 600 s, and cooling the held steel sheet to room temperature, thereby producing the high-strength galvanized steel sheet of claim 1.

6. A method for manufacturing the high-strength galvanized steel sheet of claim 2, the method comprising:

performing a hot rolling process of performing hot rolling a slab to produce a hot-rolled steel sheet having chemical composition according to claim 2 thereafter cooling and coiling;

holding the hot-rolled steel sheet, which has been obtained in the hot rolling process, or a cold-rolled steel sheet, which has been obtained by further performing cold rolling the hot-rolled steel sheet with a rolling reduction ratio of 30% or more, in a temperature range from (Ac1−5° C.) to (Ac1+10° C.) for 15 s or more while applying a tension of 0 MPa (not inclusive) to 10 MPa;

heating the held steel sheet to an annealing temperature of 750° C. to 940° C. and holding the steel sheet at the annealing temperature for 10 s to 600 s;

cooling the annealed steel sheet to a primary cooling stop temperature, which is from Ms to 550° C., under a condition in which cooling is performed at a primary average cooling rate of 3° C./s or higher in a temperature range from the annealing temperature to a temperature of 550° C.;

holding the cooled steel sheet at a galvanizing treatment temperature, which is from Ms to 580° C., for 10 s to 300 s while performing a galvanizing treatment which is optionally followed by an alloying treatment of galvanized layer;

cooling the galvanized steel sheet to a secondary cooling stop temperature of 50° C. to 350° C. under a condition in which cooling is performed at a secondary average cooling rate of 50° C./s or higher in a temperature range from the galvanizing treatment temperature to a temperature of 350° C.; and heating the cooled steel sheet to a reheating temperature which is higher than the secondary cooling stop temperature and which is within a range of 300° C. to 500° C., holding the steel sheet at the reheating temperature for 1 s to 600 s, and cooling the held steel sheet to room temperature, thereby producing the high-strength galvanized steel sheet of claim 2.

* * * * *